US010160019B2

(12) United States Patent
Gonzalez

(10) Patent No.: US 10,160,019 B2
(45) Date of Patent: Dec. 25, 2018

(54) MACHINE AND METHOD FOR THE SEMI-CONTINUOUS COLD-BENDING OF SECTIONS WITH LOW DUCTILITY

(71) Applicant: INMOTEC ASESORIA TECNICA SL, Pontevedra (ES)

(72) Inventor: Ana Perez Gonzalez, Pontevedra (ES)

( * ) Notice: Subject to any disclaimer, the term of this patent is extended or adjusted under 35 U.S.C. 154(b) by 0 days.

(21) Appl. No.: 15/314,435

(22) PCT Filed: May 22, 2015

(86) PCT No.: PCT/ES2015/070401
§ 371 (c)(1),
(2) Date: Nov. 28, 2016

(87) PCT Pub. No.: WO2015/181417
PCT Pub. Date: Dec. 3, 2015

(65) Prior Publication Data

US 2017/0203351 A1 Jul. 20, 2017

(30) Foreign Application Priority Data

May 29, 2014 (ES) ..... 201430817

(51) Int. Cl.

| | |
|---|---|
| ***B21D 7/06*** | (2006.01) |
| ***B21D 7/022*** | (2006.01) |
| ***B21D 7/024*** | (2006.01) |
| *B21D 11/20* | (2006.01) |
| *B21D 5/02* | (2006.01) |

(52) U.S. Cl.
CPC ..... *B21D 7/06* (2013.01); *B21D 7/022* (2013.01); *B21D 7/024* (2013.01); *B21D 5/0227* (2013.01); *B21D 11/203* (2013.01)

(58) Field of Classification Search
CPC ..... B21D 7/06; B21D 7/024; B21D 7/022; B21D 7/02; B21D 5/0227; B21D 5/0218; B21D 5/02; B21D 11/203; B21D 11/20
See application file for complete search history.

(56) References Cited

U.S. PATENT DOCUMENTS 4,782,686 A * 11/1988 Carson, Jr. ..... B21D 7/06 72/373
6,128,941 A * 10/2000 Russell ..... B21D 7/066 72/383
2014/0090437 A1* 4/2014 Clark ..... B21B 28/04 72/250

FOREIGN PATENT DOCUMENTS

WO WO 2012140091 A1 * 10/2012 ..... B21B 28/04

* cited by examiner

*Primary Examiner* — Pradeep C Battula
(74) *Attorney, Agent, or Firm* — Furr Law Firm; Jeffrey Furr, Esq.

(57) ABSTRACT

The invention relates to a machine and method for the semi-continuous cold-bending of sections (3) with low ductility, of the type including a horizontal mount (1) and an interchangeable tool (4) against which the section (3) is bent. The machine includes a gantry support (10). The tool (4) is located in a zone delimited by the mount (1), vertical supports (5) for the tool (4), and a compression plate (7) actuated by vertical pressure cylinders. The tool (4) is positioned facing an actuation plane defined by a double set of hydraulic positioning (23) and push (20) cylinders. The bent sections (3) can be used for tents, skylights, facades, solar shading louvres, or three-rail frames for truck tarps, guaranteeing a uniform bend in all bent sections, without the section becoming pinned in the machine during bending.

6 Claims, 2 Drawing Sheets

MACHINE AND METHOD FOR THE SEMI-CONTINUOUS COLD-BENDING OF SECTIONS WITH LOW DUCTILITY

SUMMARY

Machine and method for cold semi-continuous bending of low ductility profiles (3) of the type that comprises a horizontal bed (1) and an interchangeable tool (4) against which the bending of the profile (3) is generated.

The machine consists of a support frame (10). The tool (4) is located in an area delimited by the bed (1), vertical supports (5) of the tool (4) and a compression plate (7) operated by vertical press cylinders. The tool (4) is located in front of an operation plane defined by a double set of positioning hydraulic cylinders (23) and a pusher (20).

The bent profiles (3) can be used for tents, skylights, facade profiles, sun protection slats, or trirail bodywork for truck tarps, guaranteeing the homogeneity of the bend in all the bent profiles, without the profile being stuck in the machine during its bending.

OBJECT OF THE INVENTION

This invention belongs to the field of the technique of machinery and methods for semi-continuous cold bending of materials of low elastic limit, such as aluminium, manufactured by extrusion. It is specifically for profiles of any length, type, cross-section area and bending.

BACKGROUND OF THE INVENTION

Roller or cylinder bending machines are known in the state of the art, where a bend is generated on aluminium or other material profile by the action of three rollers located in the same plane. In this way, two rollers are placed on one side of the profile and the third roller is placed on the opposite side of the profile. This latter roller, the bending or deforming roller, is the one that exerts the transverse force on the profile (i.e. the stress in the direction of the radius of the desired bend) in order to achieve its deformation or bending; while the other two rollers serve as support and act as pull cylinders. With these machines, the profile is subjected to bending on the deforming roller in its length, thus generating a progressive deformation (as the deforming roller advancement increases) until it achieves the desired bend in the profile. This type of roller bending machines have limited use for bending of small section aluminium profiles or small or large section steel profiles because the roller support on the profile is made only on one line (line of contact). This causes that, in order to avoid deformation because of the roller "getting stuck" on the profile, the material to be bent has either to be subjected to very little stress to overcome its elastic limit and to obtain a deformation as is the case of aluminium profiles in low section profiles, or else it must be a material with high resistance to deformation, as is the case of steel profiles, that although needs more effort to generate a permanent deformation, its high resistance prevents the rollers getting stuck in the profile.

Also known in the state of the art are arch bending machines, where the bend is executed on the profile by simultaneously exerting two stresses: one perpendicular to the length of the profile against a tool which generates the bend, and another in the longitudinal direction so that between the two a deformation force can be achieved to generate a permanent deformation in the profile. This type of machines are used for open profiles and of short length since they are limited in that the size of the tool that exerts the deformation must be equal to the size of the bend to be made, therefore not allowing a bend of a semi-continuous type. Therefore, they are not valid machines for closed cross-section profiles either, since executing the two necessary forces for the process on the mentioned type of closed profile would bring to closure of the inner recess of the profile.

Also known in the state of the art is the tube bending machine, round bars and other elongated materials described in U.S. Pat. No. 5,862,698, which is provided with a positioning plate with a through hole for profile to pass to a bent or folded template. The folding template is connected to a pivotable element by the action of a hydraulic cylinder. This machine guides the profile to bend with nothing that would support the bent profile, which will bring to non-flat (i.e. twisted) bends due to stresses that will be generated during the bending process.

Likewise, patent US2008184758 describes a machine for bending of sharp-angled profiles thanks to operation of a rotating roller, driven by a hydraulic roller, on the profile which in turn is supported against a cylindrical matrix that allows to make a curve at the sharp angle by successive bends of the profile. This type of machine is known by the tube bending companies of the naval, petrochemical industry, and in smaller version, for pipes of domestic use, copper, water systems and heating of houses. As the cylinder rests in the line on the profile to be bent (line of contact), the increase of stress on the profile to be bent may bring to the risk of the profile "getting stuck".

DESCRIPTION OF THE INVENTION

The machine and method object of this invention overcomes the disadvantages of the aforementioned methods in a simple and effective manner.

It is a machine that allows different types of combinations of cold bending of aluminium profiles usually made by extrusion: semi-continuous bending, single radius bending, bending with different radiuses in different sections of the profile, or bendings of variable radius. All in aluminium profiles of any length, of open or closed type, with cross-sections inscribed in a rectangle normally of dimensions of up to 450×450 mm or equivalent, and of different lengths in a single piece of 0.25 to 30 meters.

The bent profiles can be used for tents, skylights, etc., or facade profiles, including curtain walls, as well as for sun protection slats, trirail bodywork for truck tarps, etc., guaranteeing the homogeneity of the bend in all the bent pieces, without the profile being stuck in the machine during its bending or its transversal section closing in case of closed cross-section profiles.

The machine object of this invention consists of:

- A horizontal bed
- At least one support frame on the bed and the perpendicular, with at least two feet supporting a horizontal beam raised on the bed.
- A tool (4) on which the bend is generated on the profile to be bent which is interchangeable, existing in different sizes/dimensions.
- At least one vertical support of the mentioned tool located on the bed, which can coincide with the mentioned foot of the frame.
- A double set of hydraulic cylinders, each set located on each side of the central axis of the machine (X) and in a plane lying on the bed, parallel to this and facing/ acting on the mentioned tool; and composed of: a hydraulic pusher cylinder connected via a movable sliding point through a guide to a positioning hydraulic cylinder connected on its other hand to a vertical element operated by a point of the fixed rotating support. The mentioned guide is fixed on the bed. The pushing hydraulic cylinder may be supported by a secondary guide. The free end of the pusher cylinder supports a pusher plate.

Each of these pusher cylinders (20) is equipped with a transducer.

Presser cylinders perpendicular to the bed, supported by the beams of the support frame and holding a compression plate parallel to the bed for compensation of stresses made in the profile to be bent. The mentioned presser cylinders incorporate sensors for measuring the position, load, etc. to provide information on the working parameters.

A single hydraulic pump activating all the cylinders (pushers, positioners and pressers) through valves connected to each cylinder. Alternatively, several hydraulic pumps, each connected to each cylinder or type of cylinder, may be installed.

Indicators of various types (position, mechanical load of the cylinders, etc.) connected to sensors and transducers of the cylinders, and which allow to display the operation and control parameters and control over the process of bending on the screen (for instance, that of the control computer).

Thus, the machine has a rectangular recess of variable height, which is where the tool and the profile to be bent are located. The lateral section of this recess has a variable height delimited by the compression plate and a width delimited by the feet of the frame.

The operation plane of the positioning and pusher cylinders, parallel to the bed, is preferably placed at half the height of the tool. Therefore, it is desirable that the guide and the rotating fixed support can be adjustable in height.

Therefore, the machine object of the present invention provides a number of improvements described below:

When bending a low ductility profile on the tool selected from those of length and shape suitable for the mentioned profile (i.e. depending on the length of the desired bend, for example a standard length of 2.000 mm), the initial contact of the profile on the tool is a line (a contact line between the bent surface of the tool and the straight surface of the profile) but, however, when a minimal deformation is made on the profile, the mentioned contact line becomes a surface of contact equivalent to the length of contact line multiplied by the length of deformation produced in the profile. Thus, this contact surface increases with the increase of the deformed zone and causes the increased load on the profile to shift from elastic to plastic deformation, and, thus, the load is distributed over a larger surface of the profile without producing deformation of its section.

The operation of the machine object of the present invention can be repeated in the semi-continuous form on the profile to be bent, obtaining bends of desired length, with beginning and end points on the straight profile limited in their minor separation only by the length of the tool to bend. As the tool can be replaced by tools of larger or smaller size, you can also get: bends of different radius on the same profile, bends in a different sense changing the orientation of the profile, bends of variable radius, etc. In short, any bend that is defined to conform on the tool.

As for the quality of obtained products (i.e. bent profiles), the dimensional stability of the obtained bends will be influenced by the homogeneity of the mechanical characteristics of the profiles to be bent.

DESCRIPTION OF PREFERRED FORM OF EXECUTION

Figure 1:
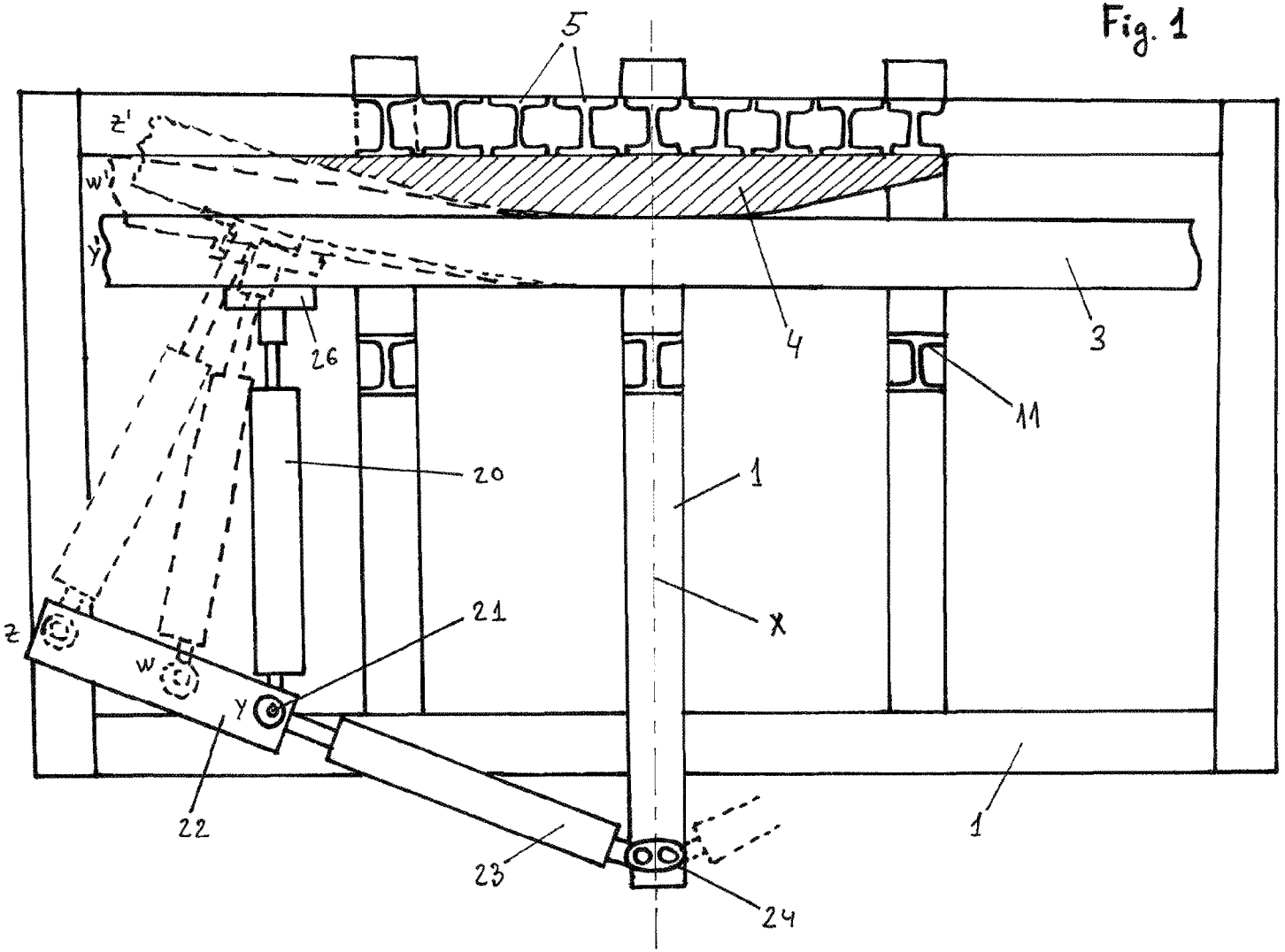
FIG. 1: View of the top floor of the machine and various operating positions (initial Y,Y', intermediate W,W' and final Z,Z') of the profile and set of cylinders on the left side (the set of cylinders on the right side of the machine is not shown).

In FIG. 1, it can be observed that the pusher cylinder (20), located to the left of the central axis of the machine (X) in horizontal position on the bed (1), is connected to the positioning cylinder (23) through the movable support point (21) which moves along the guide (22). The other, free end of the pusher cylinder (20) supports a pusher plate (26) which abuts against the profile (3) to exert a perpendicular push on the profile by the pusher cylinder (20), which is driven by a hydraulic pump and after positioning the movable support point (21) at the suitable point of the guide (22) by starting the positioning cylinder (23).

As for the positioning cylinder (23), it is placed horizontally on the bed (1) and is connected to a structural element fixed to the bed via a fixed rotating support (24) on the central axis (X) of the bed. Each of these pusher cylinders (20) is equipped with a transducer which reflects on the screen the position of the movable point (21) in the guide (22). The cylinders (20, 23) on both sides of the central axis (X) are driven by the same hydraulic pump (not shown), which starts the appropriate cylinder at each moment by means of a valve system connected to each cylinder. The hydraulic pusher cylinder (20) is supported by a secondary guide (25) fixed to the bed (1).

Figure 2:
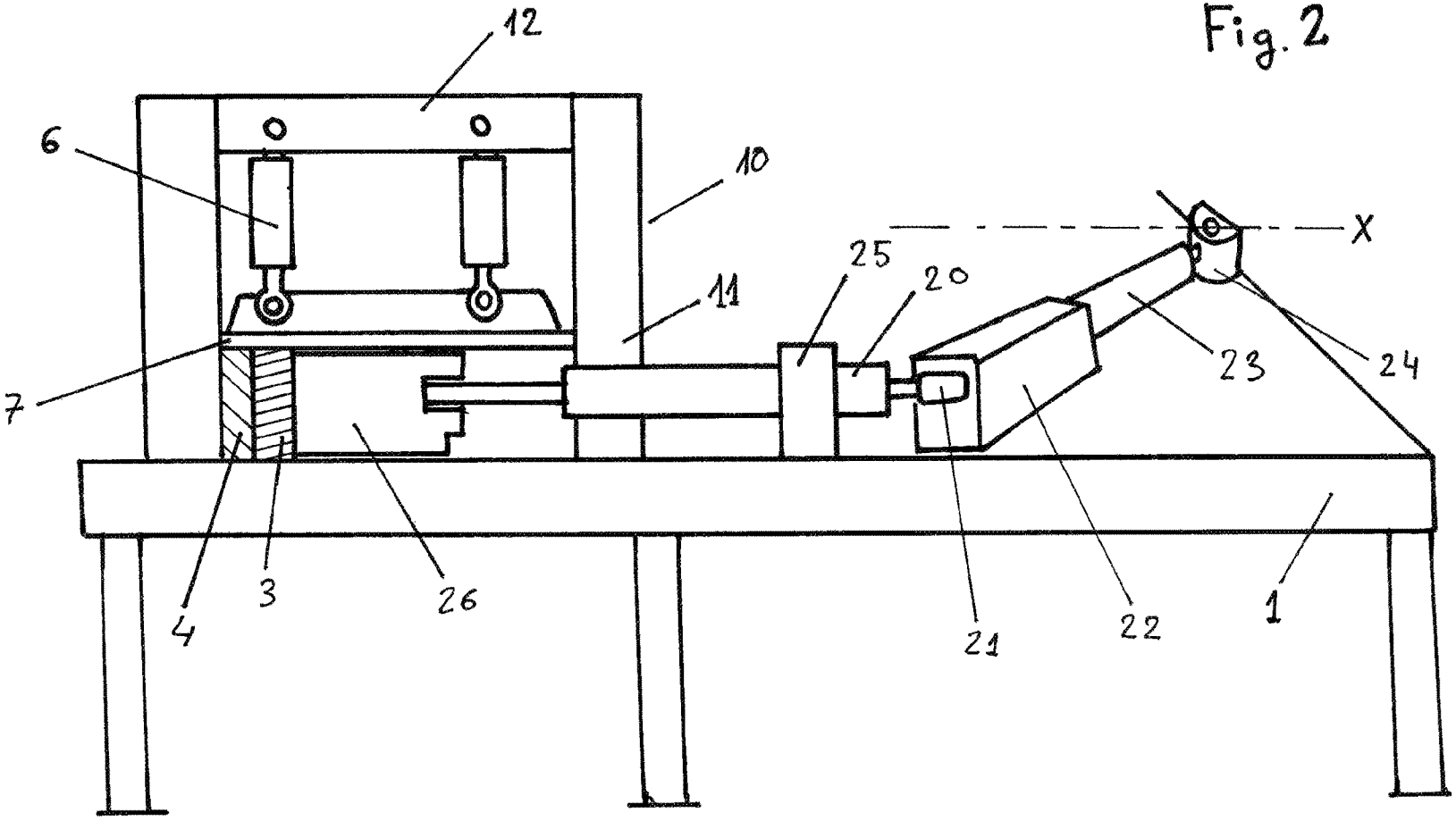
FIG. 2: Side view of the machine.

In FIG. 2, hydraulic press cylinders (6) are observed, located and operating in the vertical plane of the bed (1). The upper end of each of these cylinders is fixed and anchored in a beam (12) supported by two feet (12) of the support frame (10), holding at its bottom a compression plate (7) parallel to the bed (1) for stress compensation. As can be observed in FIG. 2, the compression plate (7) above the profile (3), and the bed (1) below the profile (3), restrain the mentioned tool (4) and profile (3) to be bent in the working position, and compensate the lateral deformation stresses to which the profile (3) is subjected when being bent. These press cylinders (6) include position, load, etc. measuring sensors in order to transmit this information relative to working parameters to a computer and/or visualization/control screen.

Therefore, as observed in both figures, on the machine bed (1), and in the operation plane formed by pusher cylinders (20) and positioners (23), and inside the operation zone of the compression plate (7), the positioning area of the tool (4) is located, on which the bending of the profile (3) will be generated. The tool (4) is placed against the vertical supports (5) made with double "T" beams with a height at least equal to that of the tool. Thus, on the bed (1), in the area defined above, the tool (4) and the profile (3) to be bent are located, with the mentioned profile (3) supported in the tool (4) by the side corresponding to the interior of the bend and with its length in the longitudinal direction of the tool (4).

Then (see FIG. 2), press cylinders (6) are made to start by means of a hydraulic pump (not shown), which move the compression plate (7) for fixing the tool (4) in its position and fixing the profile (3).

Subsequently (see FIG. 1), this profile (3) is bent by means of positioning cylinders (23) and pushers (20). Thus, initially, the positioning cylinder (23) is driven by a hydraulic pump so as to move the back (movable part (21)) of the positioning cylinder (20) to the point Y (initial position) of the guide (22), at this moment, the pusher cylinder (20) is started until the pusher plate (26) is brought into contact with the profile (3) (initial state Y'). At this moment, the pusher cylinder (20) is perpendicular to the profile. The press cylinders (6) and the compression plate (7) also serve to compensate for the transverse forces to which the profile (3) would be subjected. Therefore, as it can be seen in FIG. 2, it is important that the height of the tool (4) and of the profile (3) be the same. The positioning cylinder then advances until the movable point (21) is moved to the intermediate point W of the guide (22). Now the pusher cylinder would advance until the profile is bent to the position W'. This process goes on repeatedly until the moving point reaches the final point Z from which the profile can be carried until the desired bending (final state Z').

The movement of the back part (movable point (21)) of the pusher cylinders (20) is made so that the pusher cylinder (20) always acts perpendicularly to the profile (3) during its bending. Alternatively, this process can also be automated and done continuously with the help of additional hydraulic pumps.

Thus, as shown in FIG. 1, the profile (3) is pressed against the tool (4) by the pusher plates (26) on each side of the central axis of the machine. Thanks to the guide (22), the pusher cylinders (20) always remain perpendicular to the zone of the profile (3) where it acts until the profile (3) in its deformation reaches the previously defined point (Z') or the one selected for generating the desired bend.

If the requested bend length is greater than the bend length generated by the tool (4), the profile (3) is released and then is moved longitudinally to generate a new bent stretch as is described above. In this way, bent lengths are added in a semi-continuous process until the desired bend length is reached.

The invention claimed is:

1. A machine for cold semi-continuous bending of low ductility profiles (3), comprising a horizontal bed (1) and an interchangeable tool (4) against which said bending of the low ductility profile (3) is generated, the machine also comprising:

at least one support frame (10) on the horizontal bed (1) where said at least one support frame (10) is perpendicular to said horizontal bed (1) and comprising at least two vertical feet (11) supporting at least one horizontal beam (12), at least one vertical support (5) that is part of said interchangeable tool (4) located on the horizontal bed (1), a double set of hydraulic cylinders (20,23) in a plane situated on and parallel to the horizontal bed (1), each set of hydraulic cylinders located on one side of a central axis of the machine (X), and each set of hydraulic cylinders comprising: a hydraulic pusher cylinder (20) connected at one end to a pusher plate (26) and at the other end connected, by means of a movable point (21) sliding along a guide (22), to a hydraulic positioning cylinder (23); said hydraulic positioning cylinder (23) fixed through a fixed rotating support point (24) to a structural element fixed to the horizontal bed (1), at least one presser cylinder (6) perpendicular to the horizontal bed (1), said at least one presser cylinder (6) fixed and anchored to the at least one horizontal beam (12) with an upper end, and a lower end supporting a compression plate (7), and at least one hydraulic pump driving said at least one presser and hydraulic cylinders (20,23,6) through valves connected to each cylinder.

2. The machine for cold semi-continuous bending of low ductility profiles (3), according to claim 1, characterized in that each hydraulic pusher cylinder (20) is supported by a secondary guide (25).

3. The machine for cold semi-continuous bending of low ductility profiles (3) according to claim 1, characterized in that said hydraulic pusher cylinders (20) comprise a transducer, and said at least one presser cylinders (6) comprise a sensor of position and mechanical load measurements.

4. The machine for cold semi-continuous bending of low ductility profiles (3) according to claim 1, characterized in that at least one of the vertical feet (11) is a vertical support (5).

5. A method for cold semi-continuous bending of low ductility profiles (3), using the machine of claim 4, comprising the following steps:

select a low ductility profile (3) and an interchangeable tool (4) of suitable dimensions to said low ductility profile and to a type of a bend to be made, place the interchangeable tool (4) on the horizontal bed (1) and against said at least one vertical supports (5), position the low ductility profile (3) on the horizontal bed (1) and against said interchangeable tool (4) by a side corresponding to an inside of the bend and a length of the low ductility profile, vertically hold said interchangeable tool and low ductility profile (3) with the pusher plate (26), operating said hydraulic press cylinders (6) by means of said at least one hydraulic pump, operate the hydraulic positioning cylinder (23) by moving the movable point (21) to an initial point (Y) of the guide (22), operate the hydraulic pusher cylinder (20) until the pusher plate (26) comes into contact with the low ductility profile (3), while keeping the hydraulic pusher cylinder (20) perpendicular to the low ductility profile (3), operate the at least one presser (6) to compensate for transverse stresses to which the low ductility profile (3) is subjected, operate the positioning hydraulic cylinder (23) advancing through the movable point (21) to an intermediate point (W) of the guide (22), and operate the hydraulic pusher cylinder until the low ductility profile is bent to an intermediate position (W').

6. The method according to claim 5, further comprising the following steps:

disengage the hydraulic positioning, pusher cylinders and said at least one presser cylinder release the low ductility profile (3), move the low ductility profile (3) in a longitudinal direction of the low ductility profile, and position the low ductility profile (3) against said interchangeable tool for bending in this new fixing position.

* * * * *